US005485657A

United States Patent [19]

Kim

[11] Patent Number: 5,485,657

[45] Date of Patent: Jan. 23, 1996

[54] GARMENT HANGING CLIP AND METHOD OF USING THE SAME

[76] Inventor: Chung B. Kim, 1441 Creekside Dr., #325, Walnut Creek, Calif. 94596

[21] Appl. No.: 240,995

[22] Filed: May 11, 1994

[51] Int. Cl.[6] ..... A41F 1/00

[52] U.S. Cl. ..... 24/543

[58] Field of Search ..... 24/543, 518, 545, 24/302, DIG. 29; 2/336, 255

[56] References Cited

U.S. PATENT DOCUMENTS 897,476 9/1908 Milliken ..... 24/DIG. 29

1,772,395 8/1930 Iseman ..... 24/DIG. 29 X 1,796,365 3/1931 Goudie ..... 24/DIG. 29

2,324,654 7/1943 Tinnerman et al. ..... 24/543 X

*Primary Examiner*—James R. Brittain

*Assistant Examiner*—Robert J. Sandy

*Attorney, Agent, or Firm*—Schapp and Hatch

[57] ABSTRACT

Four embodiments are disclosed of a garment-hanger clip having a central portion adapted to be received with a garment to be hung and manually bendable wing portions adapted to be manually bent into close confrontation with the opposite sides of the central portion in order to engage the garment with prongs raised on said central portion and to maintain the garment in engagement with those prongs.

9 Claims, 5 Drawing Sheets

GARMENT HANGING CLIP AND METHOD OF USING THE SAME

BACKGROUND OF THE INVENTION

1. Field of the Invention

My present invention relates to garment hanging apparatus, and more particularly to garment hanging clips for affixing a garment to a common wire hanger.

2. Description of the Prior Art

Garment hanging clips for affixing garments to common wire hangers are well known in the prior art. Such garment hanging clips will hereinafter sometimes be called "garment-to-hanger clips" or "garment-hanger clips".

The most common type of prior art garment-hanger clips are fabricated from manually bendable metallic sheet or strip material. Such prior art garment hanging clips will sometimes hereinafter be called "metallic garment-hanger clips".

Another type of prior art of garment-hanger clips are fabricated from plastic material, and will sometimes hereinafter be called "plastic garment-hanger clips".

A common prior art metallic garment-hanger clip 10 is shown in FIGS. 3A through 3C of the present drawings.

As may be seen by comparison of FIG. 3A and FIG. 3B, prior art metallic garment-hanger clip 10 is fabricated from a single piece of manually bendable metallic sheet material which is subdivided by two bends 12, 14 into a central portion 16, a first wing portion 18, and a second wing portion 20.

As may be seen by comparing FIGS. 3A, 3B and 3C the outer end of first wing portion 18 is die-cut and formed to provide a triangular prong 22.

As may further be seen by comparison of FIGS. 3A and 3B, the outer end of second wing portion 20 is die-cut and formed to provide two triangular prongs 24, 26.

The prior art plastic garment-hanger clips are relatively expensive to manufacture, and thus must sell to the dry cleaning trade at high prices as compared with the prices of the prior art metallic garment-hanger clips.

Further, the prior art plastic garment-hanger clips are difficult to affix to and remove from a garment and its associated hanger, making it necessary to train dry cleaning plant personnel in their use, and also involving the possibility of complaints from customers who are without mechanical skills.

While the prior art metallic garment-hanger clips are relatively cheap to manufacture, and are relatively easy to install and remove without training, they are in general characterized by low shake resistance, i.e., resistance to the dislodgement of a garment from its associated hanger by the shaking produced by the motion of a garment conveyer or garment delivery truck.

The term "prior art" as used herein or in any statement made by or on behalf of applicant means only that any document or thing referred to as prior art bears, directly or inferentially, a date which is earlier than the effective filing date hereof.

No representation or admission is made that any of the devices described hereinabove is part of the prior art, or that a search has been made, or that no more pertinent information exists.

SUMMARY OF THE INVENTION

Accordingly, it is an object of my present invention to provide a new type of metallic garment-hanger clip which is less expensive than plastic garment-hanger clips of the prior art.

It is another object of my present invention to provide a new type of metallic garment-hanger clip which is characterized by higher shake resistance than the metallic garment-hanger clips of the prior art.

A further object of my present invention is to provide a new type of metallic garment-hanger clip which is easier to install than plastic garment-hanger clips of the prior art and requires no instruction for the worker in the dry cleaning plant who is familiar with prior art metallic garment-hanger clips.

A yet further object of the present invention is to provide a new type of metallic garment-hanger clip which makes it easier for the customer to remove his or her garment from the associated common wire hanger than plastic garment-hanger clips of the prior art.

Other objects of the present invention will in part be obvious, and will in part appear hereinafter.

The present invention, accordingly, comprises the several steps and the relation of one or more of such steps with respect to each of the others, and the apparatus embodying features of construction, combinations of elements, and arrangements of parts, all as exemplified in the following disclosure, and the scope of the present invention will be indicated in the claims appended hereto.

In accordance with a principal feature of the present invention a metallic garment-hanger clip is provided which is comprised of two manually bendable wing portions and a central portion which is adapted to be contained within the garment which is attached thereby to an associated wire hanger.

In accordance with another principal feature of the present invention said central portion has a first major side and a second major side opposite said first major side, a first plurality of prongs projecting from said first major side, and a second plurality of prongs projecting from said second major side.

In accordance with yet another principal feature of the present invention each of said wing portions is manually bendable into confronting relation with a corresponding one of said pluralities of said prongs.

In accordance with an additional principal feature of the present invention each of said wing portions includes an incurration which is adapted to confront the corresponding one of said pluralities of prongs when that wing portion is manually bent into confronting relation with its associated side of said central portion.

In accordance with a yet further principal feature of the present invention each of said prongs has an outer edge which is substantially parallel to one of said major sides of said central portion.

In accordance with yet another principal feature of the present invention each of said prongs has a second edge which forms an acute angle with said outer edge thereof.

In accordance with a further principal feature of the present invention each of said second edges of said prongs lies on a line which is sloped toward the outer end of one of said wing portions when the wing portion is in its unbent condition.

For a fuller understanding of the nature and objects of the present invention, reference should be had to the following detailed description, taken in connection with the accompanying drawings.

DESCRIPTION OF THE PREFERRED EMBODIMENTS

Figure 1:
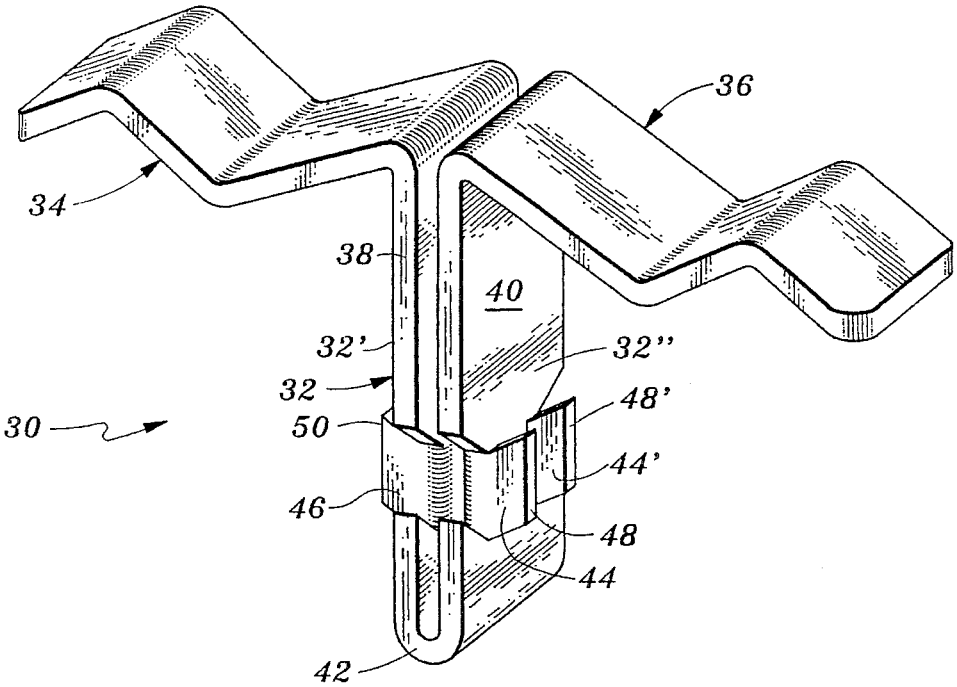
FIG. 1 is a perspective view of a garment-hanging clip embodying the present invention.
Figure 2:
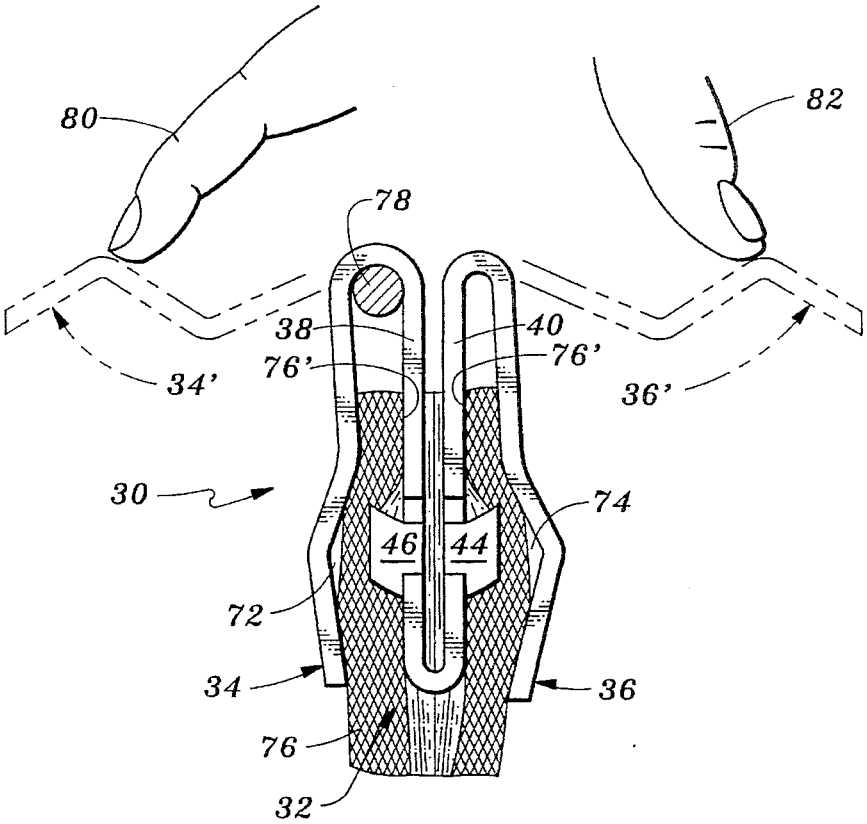
FIG. 2 is a vertical sectional view of a garment-hanging clip of the present invention, a common wire hanger, and a garment suspended from said common wire hanger by said garment-hanging clip.
Figure 3A:
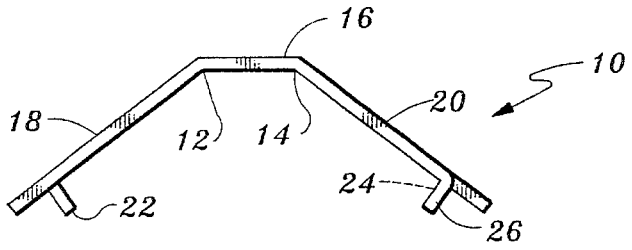
Fig. 3A (Prior Art)
FIGS. 3A through 3C illustrate a metallic garment-hanging clip of the prior art.

Referring now to FIG. 1, there is shown a garment-hanger clip 30 of the first preferred embodiment of the present invention. As seen in FIG. 1, garment-hanger clip 30 is fabricated from a single piece of metallic sheet or strip material, which is manually bendable as shown in FIG. 2, and is generally comprised of a central portion 32, a first wing portion 34, and a second wing portion 36.

As also seen in FIG. 1, central portion 32 has a first major side 32' and a second major side 32", first major side 32' being the opposite side of central portion 32 from second major side 32".

In the first preferred embodiment of the present invention, as seen in FIG. 1, central portion 32 is principally comprised of a first leg portion 38 and a second leg portion 40. First leg portion 38 and second leg portion 40 are maintained in mutually confronting juxtaposition by integral bridge portion 42.

It will thus be seen by those having ordinary skill in the art, informed by the present disclosure, that first major side 32' of central portion 32 is the major side of leg portion 38 opposite leg portion 40, and that second major side 32" of central portion 32 is the major face of second leg portion 40 opposite first leg portion 38.

Referring again to FIG. 1, it will be seen that a pair of prongs 44, 44' project outwardly from second major side 32" of central portion 32, and that a pair of prongs 46, 46' (only one of which is shown in FIG. 1) project outwardly from first major side 32' of central portion 32.

More particularly, it will be seen that prongs 44, 44' project outwardly from the major face 32" of leg 40 remote from leg 38, and that prongs 46, 46' project outwardly from the major face 32' of leg 38 remote from leg 40.

It is to be understood that each prong 44, 44' is integral with leg 40 and is bent outwardly from major side 32" thereof.

It is also to be understood that each prong 46, 46' is integral with leg 38, and is bent outwardly from major side 32' thereof.

As may best be seen by comparing FIG. 1 and FIG. 2, each prong 44, 44', 46, 46' is generally parallelogramic in shape, i.e., has the shape of a non-rectangular parallelogram.

It is to be understood that the employment of parallelogramic prongs, such as prongs 44, 44', 46, 46', in garment-hanging clips is a principal feature of the present invention.

It is also to be noted in FIG. 1 that the outer edge 48 of prong 44 is substantially parallel to major side 32" of central portion 32, and that the outer edge 48' of prong 44' is substantially parallel to major side 32" of central portion 32.

It is also to be understood that the outer edges 50, 50' of prongs 46 and 46' are parallel to major side 32' of central portion 32, i.e., are parallel to the major side 32' of leg portion 38 opposite leg portion 40.

Figure 4A:
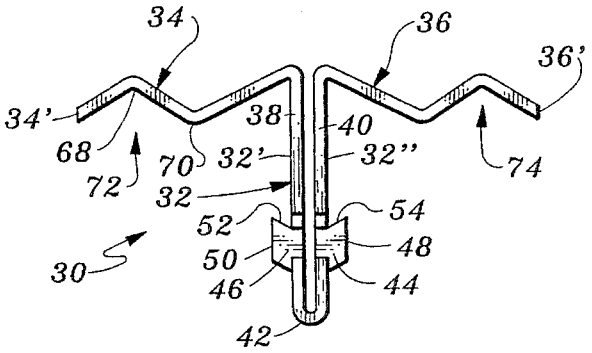
FIG. 4A is an elevational view of one of the two major faces of a garment-hanging clip of the first preferred embodiment of the present invention.
Figure 3B:
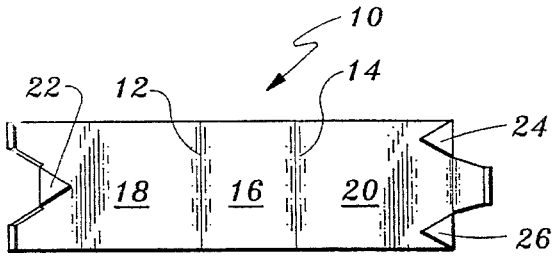
Fig. 3B (Prior Art)
Figure 4B:
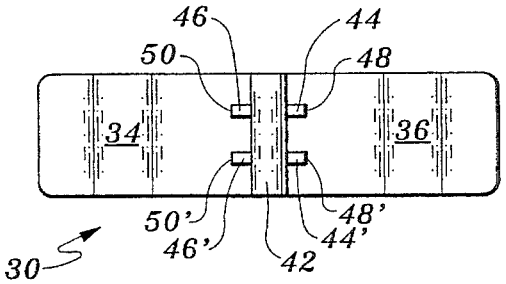
FIG. 4B is a bottom view of the garment-hanging clip of the first preferred embodiment of the present invention shown in FIG. 4A.
Figure 3C:
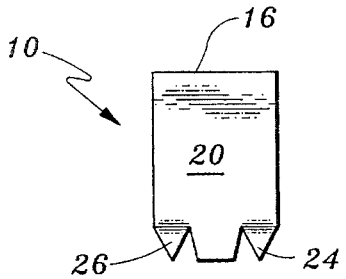
Fig. 3C (Prior Art)

Referring now to FIG. 4A, it will be seen that the upper edge of prong 44 is designated by the reference numeral 54, and that the upper edge of prong 46 is designated by the reference numeral 52.

Similarly, the upper edge of prong 44' is designated herein by the reference numeral 54', and the upper edge of prong 46 is designated by the reference numeral 52.

Figure 4C:
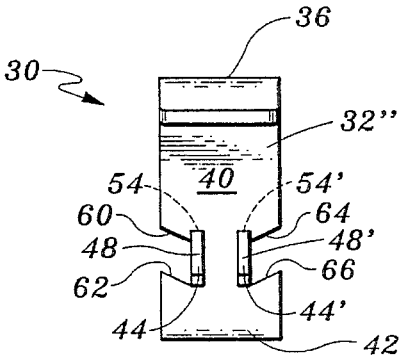
FIG. 4C is an end view of the garment-hanging clip of the first preferred embodiment of the present invention shown in FIGS. 4A and 4B.

Comparing FIG. 4A with FIG. 4C, it will be seen that upper edge 54 of prong 44 makes an acute angle with outer edge 48 of prong 44, and that the upper edge 54' of prong 44' makes an acute angle with outer edge 48' of prong 44'.

Similarly, it will now by understood by those having ordinary skill in the art, informed by the present disclosure, that the upper edge 52 of prong 46 makes an acute angle with the outer edge 50 of prong 46, and that the upper edge 52' of prong 46' makes an acute angle with the outer edge 50' of prong 46'.

Going again to FIG. 4A, it will be seen that the plane containing the upper edge 52 of prong 46, when projected upwardly from prong 46, passes close to the outer end 34' of wing portion 34, and that the plane containing the upper edge 54 of prong 44, when projected upwardly, passes close to the outer end 36' of wing portion 36.

Thus, it will be seen that the upper edge 52 of prong 46 lies on a line which is sloped toward wing portion 34, and that the upper edge 54 of prong 44 lies on a line which is sloped toward wing portion 36.

As best seen in FIG. 4C, prong 48 is a part of leg 40 which originally lay between two cuts 60, 62, and was bent into perpendicularity with respect to major face 32" of leg 40.

Similarly, it will be seen in FIG. 4C that prong 44' was originally a part of leg 40 which lay between cuts 64 and 66, and was then bent into perpendicularity with respect to the major face 32" of leg 40.

Comparing FIG. 4A with FIG. 4C, it will be seen that prongs 46 and 46' were portions of leg 38 lying between pairs of cuts directed obliquely to the outer edges of leg 38, and which were then bent perpendicular with respect to the major face 32' of leg 38.

Returning to FIG. 4A, there is illustrated a further principal feature of the present invention.

In FIG. 4A it will be seen that wing portion 34 is formed with two transverse bends 68, 70, bend 68 being an upward bend and bend 70 being a downward bend.

Thus, wing portion 34 is so configured as to form a downward concavity 72 which lies between the outer end 34' of wing portion 34 and downward bend 70.

Similarly, wing portion 36 is provided with an upward bend and a downward bend whereby a concavity 74 similar to concavity 72 is provided at the outer end of wing portion 36.

As seen in FIG. 2, concavities 72 and 74 are so formed, and so located along the lengths of wing portions 34 and 36, respectively, that when wing portions 34 and 36 are manually bent into confronting relation with central portion 32, prongs 46 and 46' confront concavity 72, and prongs 44 and 44' confront concavity 74.

Referring again to FIG. 2, the method of the present invention by which a garment 76 is affixed to the horizontal linear portion 78 of a common wire hanger will now be described.

As will be evident to those having ordinary skill in the art, informed by the present disclosure, two garment-hanger clips 30 of the present invention are required to attach garment 76 to horizontal hanger portion 78. The installation of one clip 30 is shown in FIG. 2, and described hereinbelow in connection therewith, it being understood that the other clip 30, located near the other end of horizontal hanger portion 78, is, in accordance with the present invention, installed in the same manner as is clip 30 shown in FIG. 2.

It is further to be understood that in FIG. 2 garment 76 is shown only in part, which part is the upper edge part of a skirt adjacent the waist opening thereof.

As may be seen from FIG. 2, then, the hanger clip installation me%hod of the present invention may be described as follows.

The upper edge of skirt 76, including waist opening 76', is juxtaposed to horizontal hanger portion 78 as shown in FIG. 2.

An open or unbent hanger clip 30 (FIG. 1) is grasped in the installer's other hand and is then positioned above the open waist end of skirt 76 with one of its wings (34) positioned above horizontal hanger portion 78.

Central portion 32 of hanger clip 30 is then thrust into the waist opening 76' of skirt 76 so that the upper edge of skirt 76 is positioned well above concavities 72 and 74.

Wing portions 34 and 36 are then bent by the forefinger 80 and thumb 82, respectively, of the installer's hand, from the dashed line position shown in FIG. 2 to the solid line position shown in FIG. 2, until the upper end of skirt 76 is firmly clamped between wing portions 34 and 36 and central portion 32.

It is to be noted that in accordance with the principles of the present invention the parallelogramic shape of prongs 44 and 46 limits the engagement of the sharp upper corners of prongs 44 and 46 with skirt 76, but at the same time engagement of skirt 76 with these sharp upper corners of prongs 44 and 46 is assured by the configuration of concavities 72 and 74, and the juxtaposition thereof to these sharp upper corners.

After the installation of one of the garment-hanger clips 30 of the first preferred embodiment of the present invention near one end of waist opening 76', and near the corresponding end of horizontal hanger portion 78, as just described, a second garment-hanger clip 30 of the first preferred embodiment is installed at the other end of the waist opening and the horizontal hanger portion by the same method, and thus skirt 76 is attached to horizontal hanger portion 78 in accordance with the method of the present invention.

Figure 5A:
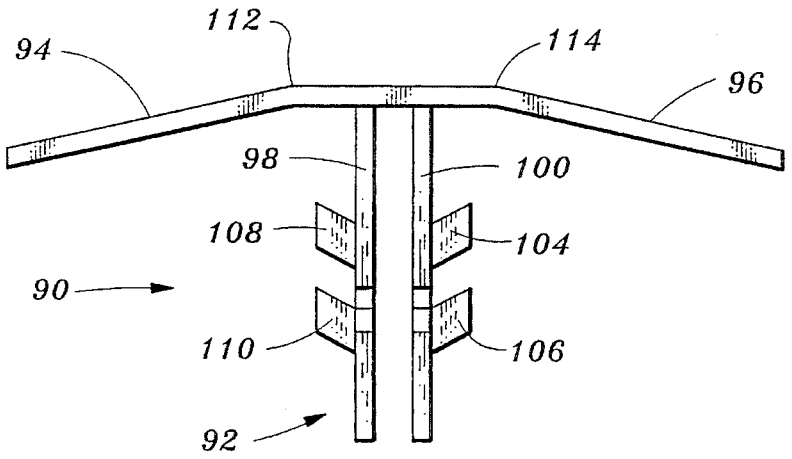
FIGS. 5A through 5C represent a garment-hanging clip of the second preferred embodiment of the present invention.
Figure 5B:
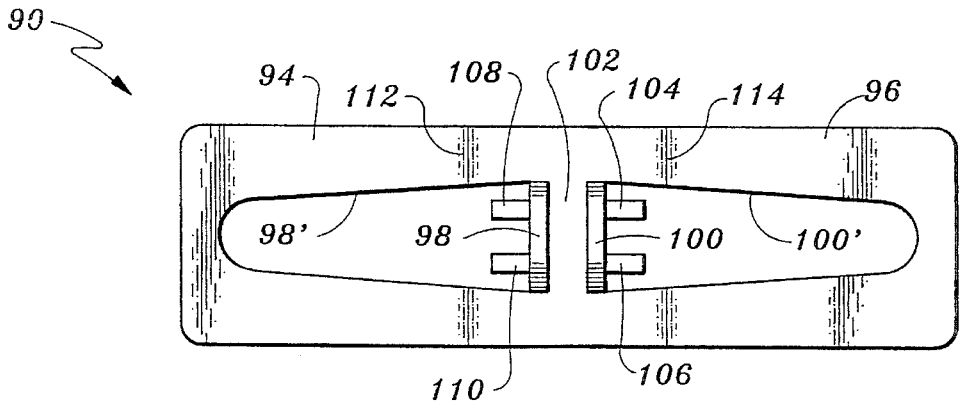
Figure 5C:
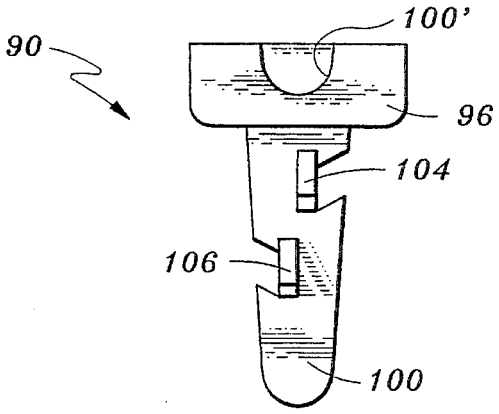

Referring now to FIGS. 5A, 5B and 5C, there is shown a garment-hanger clip 90 of the second preferred embodiment of the present invention.

As best seen in FIG. 5A, clip 90 is comprised of a central portion 92, a first wing portion 94, and a second wing portion 96.

As also seen in FIG. 5A, central portion 92 is comprised of two legs 98 and 100.

It is to be noted, however, that in contrast with the garment-hanger clip 30 of the first preferred embodiment, the lower ends of legs 98 and 100 are not joined by a bridge portion.

Rather, as best seen in FIG. 5B, legs 98 and 100 are joined at their upper ends by an upper bridge portion 102.

As also best seen in FIG. 5B, cuts 98', 100', which define the outer edges of legs 98, 100, are provided in wing portions 94 and 96, respectively.

In the fabrication of garment-hanger clip 90, legs 98 and 100 are bent out of wings 94 and 96, and then prongs 104,106, 108, 110 are bent outwardly from legs 98 and 100 in the manner in which prongs 44, 46, etc., are bent outwardly from legs 38 and 40 in the garment-hanger clip 30 of the first preferred embodiment.

During the fabrication of garment-hanger clips 90 bends 112,114 are provided in order to aid in the manual bending of wing portions 94 and 96 into gripping relationship with a skirt or other garment.

Figure 6A:
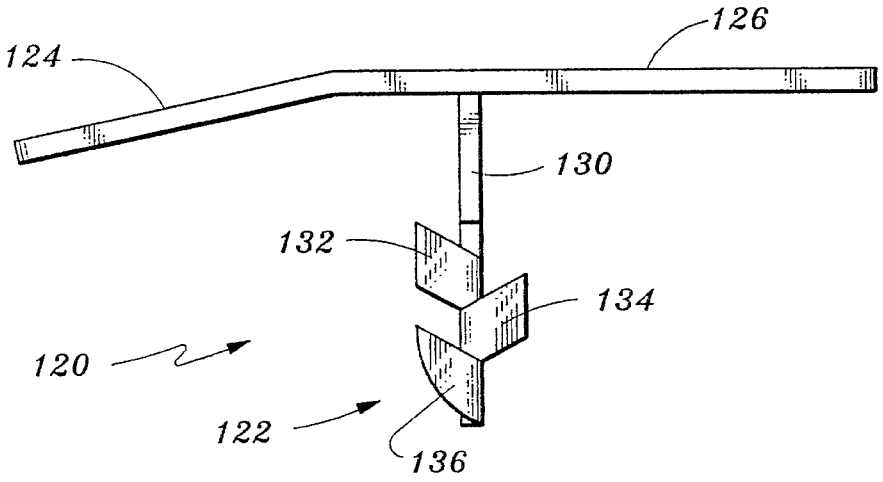
FIGS. 6A through 6C represent a garment-hanging clip of the third preferred embodiment of the present invention.
Figure 6B:
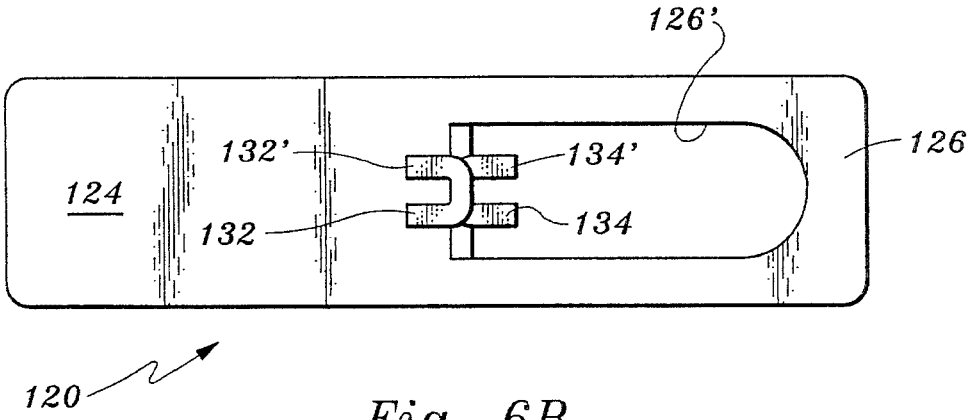
Figure 6C:
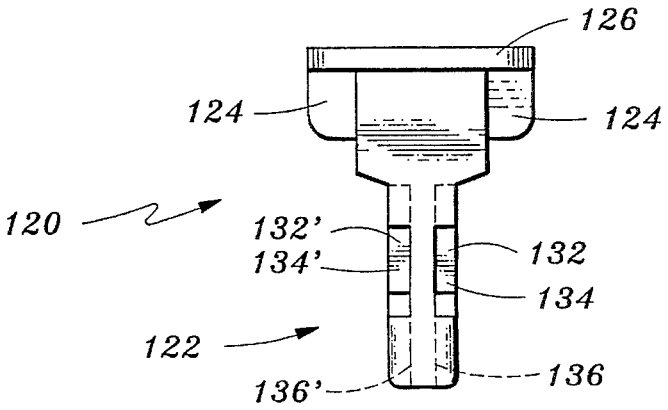

Referring now to FIGS. 6A, 6B and 6C, there is shown a garment-hanger clip 120 of the third preferred embodiment of the present invention.

As best seen in FIG. 6A, garment-hanger clip 120 is comprised of a central portion 122, a first wing portion 124, and a second wing portion 126.

In the third preferred embodiment of the present invention central portion 122 is comprised of a single leg 130.

The outer edge of leg 130 is defined by a cut 126' in wing portion 126 (FIG. 6B).

As best seen in FIG. 6A, leg 130 is bent downwardly into perpendicularity with wing portion 126, and then prongs 132, 132', 134', 134', 136 and 136' are bent outwardly from leg 130 in the manner best seen by comparison of FIGS. 6A and 6B.

Figure 7A:
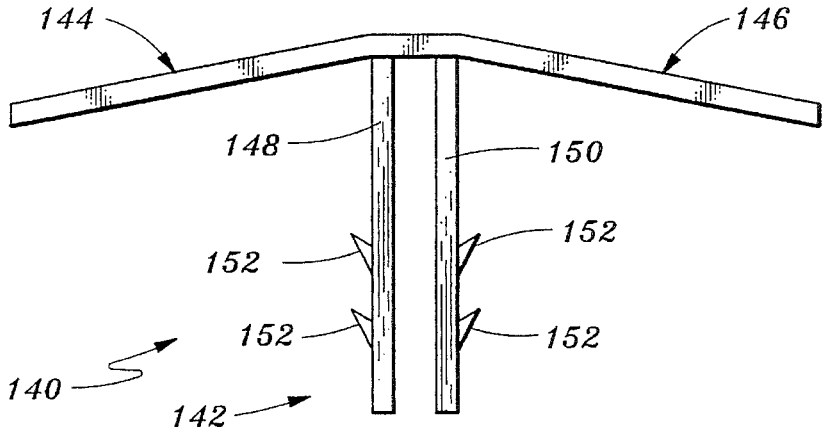
FIGS. 7A through 7C represent a garment-hanging clip of the fourth preferred embodiment of the present invention.
Figure 7B:
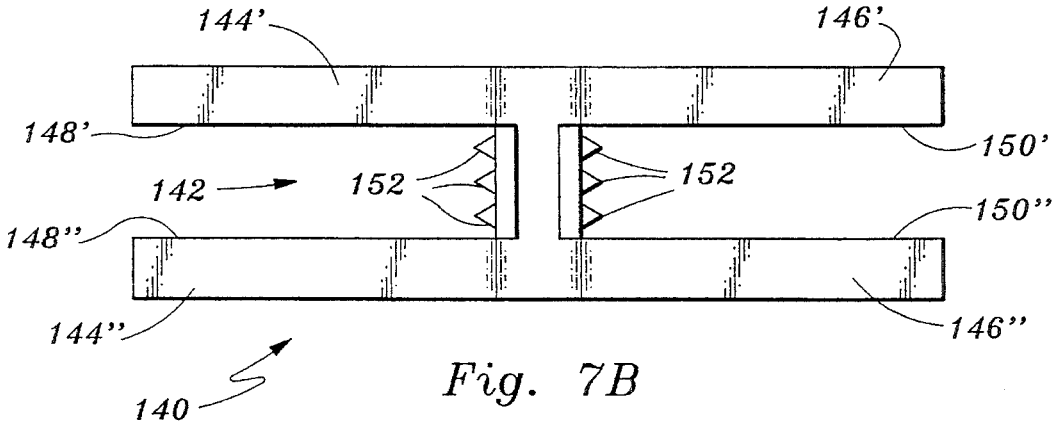
Figure 7C:
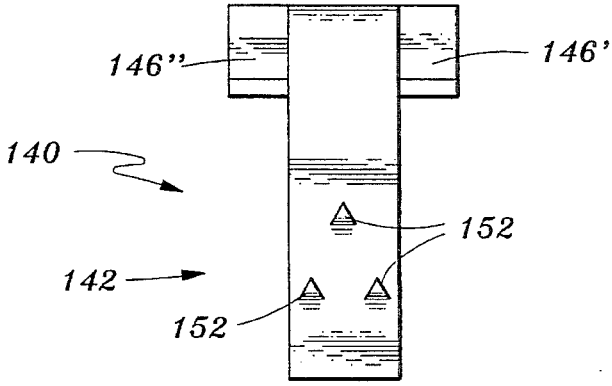

Referring now to FIGS. 7A, 7B, and 7C, there is shown a garment-hanger clip 140 of the fourth preferred embodiment of the present invention.

As best seen in FIG. 7A, garment-hanger clip 140 is comprised of a central portion 142, a first wing portion 144, and a second wing portion 146.

As also seen in FIG. 7A, central portion 142 is comprised of two leg portions 148, 150, which are not joined by a bridge portion at their lower ends.

It is also to be noted as particular to the fourth preferred embodiment that wing portion 144 is comprised of two wing members 144' and 144", and that wing portion 146 is comprised of two wing members 146' and 146".

As best seen in FIG. 7B, the outer edges of legs 148 and 150 are defined by cuts 148', 148", 150', 150".

Before the bending of legs 148 and 150 into their perpendicular position as shown in FIG. 7A, a plurality of triangular prongs 152 are punched from and raised upon legs 148 and 150, respectively.

The garment-hanger clips of the second, third and fourth preferred embodiments are installed upon a garment and associated hanger by the same method of the present invention described hereinabove in connection with the first preferred embodiment.

It will thus be seen that the objects set forth above, among those made apparent from the preceding description, are efficiently attained, and since certain changes may be made in the above constructions and the method carried out thereby without departing from the scope of the present invention, it is intended that all matter contained in the above description or shown in the accompanying drawings shall be interpreted as illustrative only, and not in a limiting sense.

It is also to be understood that the following claims are intended to cover all of the generic and specific features of the invention hereindescribed, and all statements of the scope of the invention which, as a matter of language, might be said to fall therebetween.

What is claimed is:

1. A garment hanging clip, comprising:

an elongated central portion having a first major face and a second major face opposite said first major face;

a first plurality of prongs projecting outwardly from said first major face;

a second plurality of prongs projecting outwardly from said second major face;

a first wing portion extending outwardly from said elongated central portion;

a second wing portion extending outwardly from said elongated central portion;

said first wing portion being manually bendable into confronting relation with said first plurality of prongs, and continuing to confront said first plurality of prongs after the manually applied bending force is no longer applied; and said second wing portion being manually bendable into confronting relation with said second plurality of prongs, and continuing to confront said second plurality of prongs after the manually applied bending force is no longer applied.

2. A garment hanging clip as claimed in claim 1 in which said elongated central portion is comprised of a first leg portion having elongated edges and a second leg portion having elongated edges and confronting said first leg portion when said clip is in use.

3. A garment hanging clip as claimed in claim 2 in which said leg portions are maintained in confronting relation by a bridge portion which is integral with an inner end of said first leg portion and is also integral with an inner end of said second leg portion, said inner end of said first leg portion confronting said inner end of said second leg portion.

4. A garment hanging clip as claimed in claim 2 in which said first major side of said central portion is the side of said first leg portion opposite the side thereof which confronts said second leg portion, and said second major side of said central portion is the side of said second leg portion opposite the side thereof which confronts said first leg portion.

5. A garment hanging clip as claimed in claim 2 in which the prongs of said first plurality are outwardly turned portions of said elongated edges of said first leg portion, and the prongs of said second plurality are outwardly turned portions of said elongated edges of said second leg portion.

6. A garment hanging clip as claimed in claim 1 in which each prong of said first plurality has an outer edge which is substantially parallel to said first major side of said elongated central portion, and each prong of said second plurality has an outer edge which is substantially parallel to said second major side of said elongated central portion.

7. A garment hanging clip as claimed in claim 6 in which each prong of said first plurality has a second edge which forms an acute angle with said outer edge thereof, and each prong of said second plurality has a second edge which forms an acute angle with said outer edge thereof.

8. A garment hanging clip as claimed in claim 7 in which each of said second edges of said prongs lies on a line which is sloped toward one of said wing portions.

9. A garment hanging clip, comprising:

an elongated central portion having a first major side and a second major side opposite said first major side;

a first plurality of prongs projecting from said first major side;

a second plurality of prongs projecting from said second major side;

a first wing portion extending outwardly from said elongated central portion;

a second wing portion extending outwardly from said elongated central portion;

said first wing portion being manually bendable into confronting relation with said first plurality of prongs; and said second wing portion being manually bendable into confronting relation with said second plurality of prongs;

said elongated central portion being comprised of a first leg portion having elongated edges and a second leg portion having elongated edges and confronting said first leg portion when said clip is in use;

the prongs of said first plurality being outwardly turned portions of said elongated edges of said first leg portion; and the prongs of said second plurality being outwardly turned portions of said elongated edges of said second leg portion.

* * * * *